United States Patent [19]

König

[11] Patent Number: 5,016,324

[45] Date of Patent: May 21, 1991

[54] FEEDER FOR SUPPLYING FIBERS TO AN APPARATUS FOR FORMING A PRELIMINARY WEB

[75] Inventor: Franz König, Linz, Austria

[73] Assignee: Textilmaschinenfabrik Dr. Ernst Fehrer Aktiengesellschaft, Leonding, Austria

[21] Appl. No.: 477,043

[22] Filed: Feb. 7, 1990

[30] Foreign Application Priority Data

Feb. 23, 1989 [AT] Austria ..... 405/89

[51] Int. Cl.[5] ..... D01G 23/04

[52] U.S. Cl. ..... 19/296; 19/105

[58] Field of Search ..... 19/296, 105, 97.5

[56] References Cited

U.S. PATENT DOCUMENTS

| | | | |
|---|---|---|---|
| 3,881,225 | 5/1975 | Lambert | 19/296 X |
| 4,045,091 | 8/1977 | Beneke | 19/105 X |
| 4,085,977 | 4/1978 | Varga | 19/105 X |
| 4,106,163 | 8/1978 | Desvarchére | 19/296 |
| 4,154,485 | 5/1979 | Lytton et al. | 19/105 X |
| 4,240,180 | 12/1980 | Wood et al. | 19/105 |
| 4,280,251 | 7/1981 | Ludwig | 19/105 |
| 4,462,140 | 7/1984 | Wood | 19/105 |
| 4,531,262 | 7/1985 | Reiche | 19/105 X |
| 4,580,960 | 4/1986 | Apman et al. | 19/296 X |
| 4,694,538 | 9/1987 | Pinto et al. | 19/105 |

FOREIGN PATENT DOCUMENTS 1422861 1/1976 United Kingdom .

*Primary Examiner*—Werner H. Schroeder
*Assistant Examiner*—John J. Calvert
*Attorney, Agent, or Firm*—Kurt Kelman

[57] ABSTRACT

A feeder for supplying fibers to an apparatus for forming a preliminary web having a holding shaft, to be supplied with fibers from above through a conveying line, and a distributor, which is disposed between the holding shaft and the conveyor line and serves to distribute the arriving stream of fibers over the width of the shaft. In order to ensure an undisturbed distribution of fibers, the distributor has at least two distributing lines, which open into the holding shaft and are connected to the conveying line in alternation by a change-over valve.

2 Claims, 2 Drawing Sheets

FEEDER FOR SUPPLYING FIBERS TO AN APPARATUS FOR FORMING A PRELIMINARY WEB

BACKGROUND OF THE INVENTION

1. Field of the Invention

This invention relates to a feeder for supplying fibers to an apparatus for forming a preliminary web, comprising a holding shaft, which is adapted to be supplied with fibers from above from a conveying line and is closed at the bottom by at least one discharge roller, and a distributor, which is disposed between the holding shaft and the conveyor line and serves to distribute the arriving stream of fibers over the width of the shaft in the axial direction of the discharge roller, wherein the distributor comprises at least two distributing lines, which serve to receive fibers from the conveying line and open into the holding shaft at locations which are distributed over the width of the shaft.

2. Description of the Prior Art

It is known that a preliminary web which is as uniform as possible can be supplied, e.g., to a card in that the fibrous material is first supplied to a holding shaft from above from a conveyor line and the fibrous material is discharged from the holding shaft by at least one discharge roller, which closes the holding shaft at its bottom, whereafter the belt conveyor forwards the discharged fibers onto an elevator lattice, which is succeeded by a vibrating shaft for forming a so-called flake mat, which is then fed as a preliminary web to the card for further processing. The uniformity of such preliminary web will depend on the uniformity of the stream of fibers discharged from the holding shaft over the length of the discharge roller and said uniformity requires a uniform distribution of the fibers supplied to the holding shaft over the width of said shaft, which width extends in the axial direction of the discharge roller. To permit a uniform distribution over a substantial shaft width of the stream of fibers which are supplied from a suitable conveying line, various distributors have been employed and it has been found that distributors comprising a distributing tube which is reciprocable over the width of the shaft are superior to those distributors which comprise a distributing line which flares like an inverted funnel over the width of the shaft. The known distributor comprising a moving distributing tube have the disadvantage that the structural expenditure is relatively high and, above all, that clearance spaces will necessarily occur in the transitional region between the stationary conveyor line and the moved distributing tube and fibers may deposit in such clearance spaces so that the movement of the distributing tube will be restrained and said deposited fibers may initiate a formation of substantial accumulations of fibers, by which the conveyance of the fibers is highly adversely affected. These remarks are applicable to distributors comprising a pendulum tube, which swings over the width of the shaft, and to distributors which comprise a distributing tube that is parallel to the discharge roller and can be telescopically extended and retracted.

From British Patent Specification No. 1,422,861 it is known to provide a distributor which comprises two distributing lines, which are adapted to be connected to a conveying line and which open into the holding shaft at locations which are distributed over the width of the shaft. That known distributor has the disadvantage that the distribution of the fibers to the two distributing lines is pneumatically effected by a control of the air supply so that it is not possible to close one of the two distributing lines and the distribution of the fibers over the width of the shaft will be disturbed because a predetermined distribution of fibers cannot readily be maintained.

SUMMARY OF THE INVENTION

It is an object of the invention to avoid said disadvantages and so to improve with simple means a feeder of the kind described first hereinbefore for supplying fibers to an apparatus for forming a preliminary web that a sufficiently uniform distribution of the fibers over the width of the shaft can be achieved without a need for a distributing tube which is reciprocable over the width of the shaft or for a division of the stream of fibers which are supplied.

The object set forth is accomplished in accordance with the invention in that the distributing lines are adapted to be connected to the conveying line in alternation by a change-over valve.

Because at least two stationary distributing lines are provided, which are connected to the conveying line in alternation, it is suprisingly possible to ensure a sufficiently uniform distribution of the fibers over the width of the shaft so that the fibers will be uniformly distributed over the cross-section of the shaft on the surface of the body of fibers held in the shaft and this can be achieved without a need for a special structural expenditure. Change-over valves for connecting at least two branch lines in alternation to a conveying line for fibrous material are known in the form of change boxes and have proved satisfactory in practice and a deposition of fibers on the movable valve member, which deposition would result in substantial accumulations of fibers, can be precluded.

The number of distributing tubes may be selected in dependence on the conditions encountered in each case and will mainly depend on the shaft width over which the fibrous material is to be uniformly distributed. For a control of the change-over valve, surface level detectors may be associated with the holding shaft and may be used to monitor the surface level of the fibrous material in a local region so that said surface level may readily be maintained in a predetermined desired range if the change-over valve is actuated in time.

DETAILED DESCRIPTION OF THE PREFERRED EMBODIMENT

Figure 1:
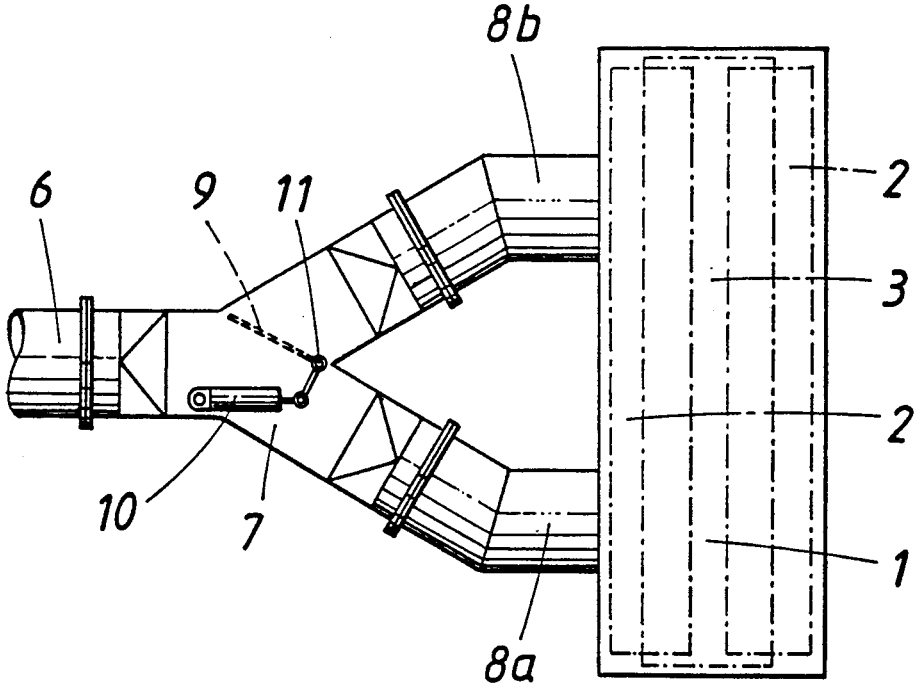
FIG.1 is a simplified top plan view showing a feeder in accordance with the invention for supplying fibers to an apparatus for forming a preliminary web.
Figure 2:
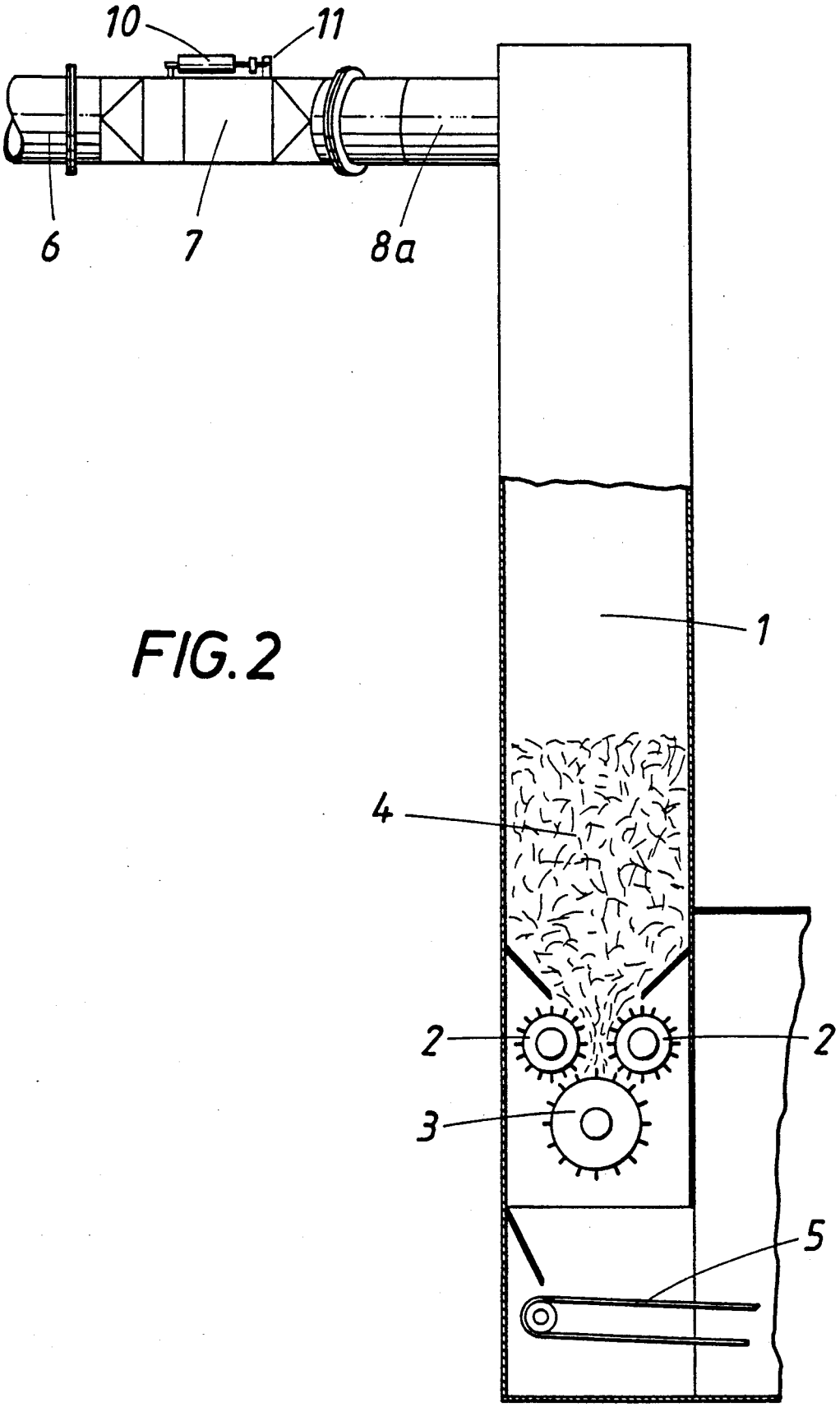
FIG. 2 is a diagrammatic side elevation showing that apparatus partly torn open.

The invention will now be described by way of example with reference to the drawing.

In the embodiment shown by way of example a conventional apparatus for forming a preliminary web is fed by means of a holding shaft 1, which is closed at its bottom by a discharge roller 3, which cooperates with two feed rollers 2. The discharge roller 3 receives fibrous material 4 from the holding shaft 1 and throws said fibrous material onto a belt conveyor 5, which extends to an elevator lattice, not shown, which delivers the fibrous material 4 to a vibrating shaft, by which a preliminary web is formed, which consists of a flake mat and is withdrawn from the vibrating shaft by means of a belt conveyor and is then supplied, e.g., to a card for further processing.

The holding shaft 1 is supplied with fibers from above through a conveyor line 6, which is connected by a change-over valve 7 to two distributing lines 8*a* and 8*b*, which open into the holding shaft 1 at locations which are distributed over the width of the shaft, i.e., over the axial direction of the discharge roller 3. This is apparent from FIG. 1. The change-over valve 7 consists of a change box and comprises a change-over flap 9 and is operable by means of a turning cylinder 10, which is connected by a crank arm to the shaft 11 for actuating the change-over flap 9. Upon an actuation of the change-over flap 9 from the position shown in FIG. 1 the distributing line 8*a* which is then connected to the conveying line 6 is closed and the distributing line 8*b* is exposed at the same time so that the stream of fibers from the conveyor line is delivered into the holding shaft 1 via the distributing line 8*b* rather than via the distributing line 8*a* and falls in a free flight onto the existing body of fibers and is properly distributed over a substantial strewing range so that the surface level of fibers is increased mainly in one half of the shaft. After a further actuation of the change-over flap 9 to the initial position shown in FIG. 1 the surface level of the body of fibers is caused to follow up in the other half of the shaft so that a suitable distribution of fibers over the width of the shaft in the axial direction of the discharge roller 3 will always be ensured. It must be borne in mind that the strewing ranges of the two distributing lines 8*a* and 8*b* overlap so that the strewing density which decreases outwardly will be compensated in the overlap region.

It will be understood that the invention is not restricted to the embodiment illustrated by way of example. For instance, if the shaft has a larger width in the axial direction of the discharge roller 3 it will be possible to provide three and more distributing lines, which are connected by a suitable change-over valve to the conveyor line 6 in succession so that a uniform distribution of fibers over the width of the shaft will be ensured.

I claim:

1. In a feeder for supplying fibers to an apparatus for forming a preliminary web, comprising a holding shaft having top and bottom ends, a conveying line for supplying fibers to the top end of said shaft, means comprising a discharge roller for closing said shaft at said bottom end, said holding shaft having a width in the axial direction of said discharge roller, and a distributor, disposed between said conveying line and said holding shaft and serving distribute fibers coming from said conveying line over the width of said holding shaft, the distributor comprising at least two distributing lines for receiving fibers from said conveying line and open into said shaft at locations distributed over the width of said shaft, The improvement comprising a change-over valve connecting said distributing lines to said conveying line in alternation.

2. The improvement set forth in claim 1, comprising for controlling said change-over valve said means comprising surface level dectectors associated with said shaft and responsive to the surface level of the fibers in said shaft.

* * * * *